US007913736B2

(12) United States Patent
Sakurai et al.

(10) Patent No.: US 7,913,736 B2
(45) Date of Patent: Mar. 29, 2011

(54) APPARATUS AND METHOD FOR AFFIXING ADHESIVE TAPE

(75) Inventors: Yasuharu Sakurai, Kohka (JP); Kousaku Yamada, Kohka (JP)

(73) Assignee: NHK Spring Co., Ltd., Yokohama (JP)

( * ) Notice: Subject to any disclaimer, the term of this patent is extended or adjusted under 35 U.S.C. 154(b) by 517 days.

(21) Appl. No.: 11/902,285

(22) Filed: Sep. 20, 2007

(65) Prior Publication Data

US 2008/0078507 A1 Apr. 3, 2008

(30) Foreign Application Priority Data

Oct. 3, 2006 (JP) ..... 2006-272258

(51) Int. Cl.
*B65C 3/02* (2006.01)

(52) U.S. Cl. ..... 156/510; 156/220; 156/495; 156/230; 156/250; 156/64

(58) Field of Classification Search ..... 53/135.1, 53/136.1–136.5, 389.3; 156/510, 220, 230, 156/64, 250, 304.3, 556
See application file for complete search history.

(56) References Cited

U.S. PATENT DOCUMENTS

2006/0081321 A1* 4/2006 Bradshaw et al. ..... 156/64
2006/0137827 A1* 6/2006 Uneyama et al. ..... 156/510
2007/0012404 A1* 1/2007 Briese et al. ..... 156/361
2008/0011403 A1* 1/2008 Saito et al. ..... 156/64

FOREIGN PATENT DOCUMENTS

JP A-08-169428 7/1996
JP A-2001-225820 8/2001

* cited by examiner

*Primary Examiner* — Kat Wyrozebski
*Assistant Examiner* — Keith T Aziz
(74) *Attorney, Agent, or Firm* — Oliff & Berridge, PLC

(57) ABSTRACT

An apparatus affixes an adhesive tape to a workpiece having a cylindrical portion and an outer peripheral surface. The apparatus comprises a tape-feeding device for feeding an adhesive tape below the outer peripheral surface such that the adhesive surface faces upwardly in a direction approximately perpendicular to an axis of the cylindrical portion, a tape-cutting device for cutting the adhesive tape fed from the tape-feeding device in a predetermined length, and a tape-affixing device for thrusting and affixing the adhesive surface of the adhesive tape which was cut by the tape-cutting device to the outer peripheral surface of the cylindrical portion such that the tape-affixing device passes through both sides of the outer peripheral surface of the cylindrical portion from below thereof so as to elevate the adhesive tape. The tape-affixing device is arranged for cut adhesive tape longer than the length of the outer periphery of the cylindrical portion such that adhesive surfaces at ends of the cut adhesive tape are pressed and are adhered each other after the adhesive surface of the adhesive tape was thrust and was adhered to the outer peripheral surface of the cylindrical portion.

8 Claims, 6 Drawing Sheets

APPARATUS AND METHOD FOR AFFIXING ADHESIVE TAPE

BACKGROUND OF INVENTION

1. Technical Field

The present invention relates to apparatuses for affixing an adhesive tape to a workpiece and to a method for affixing an adhesive tape, and specifically, the invention relates to improvements in techniques for affixing adhesive tape to workpieces having a cylindrical portion.

2. Background Art

Adhesive tapes, such as labels printed with various types of product information or with barcodes, may be automatically affixed to an outer peripheral surface of a cylindrical portion of a workpiece. As methods for affixing such adhesive tapes, for example, see Japanese Unexamined Application Publications Nos. 8-169428 (first patent document) and 2001-225820 (second patent document).

In the technique disclosed in the first patent document, an adhesive tape is cut in a predetermined length by a tape-feeding portion, and the cut adhesive tape is fed to a tape-holding mechanism. The cut adhesive tape is affixed to an outer peripheral surface of a bar-shaped workpiece disposed perpendicularly to the adhesive tape on a base in the tape-holding mechanism. In the technique disclosed in the second patent document, an adhesive tape with a predetermined size is held between a thrust roller and a cylindrical container which is vertically held by a container-holding device. Then, the adhesive tape is affixed to an outer peripheral surface of the cylindrical container by rotating the cylindrical container.

In the technique of the first patent document, the adhesive tape is affixed to the outer peripheral surface of the workpiece from above in a condition in which an adhesive surface faces downward, whereby the workpiece is difficult to pull out after the adhesive tape is affixed. On the other hand, in the second patent document, the adhesive tape is affixed to the outer peripheral surface of the cylindrical container by rotating the cylindrical container with respect to the adhesive tape. Therefore, it is difficult to produce a free-hanging tag by affixing an adhesive tape that is longer than the length of the outer periphery of the cylindrical container.

SUMMARY OF THE INVENTION

An object of the present invention is to provide an apparatus and a method for affixing an adhesive tape, wherein a workpiece is upwardly pulled out after the adhesive tape is affixed, and the adhesive tape is affixed to the outer peripheral surface of the cylindrical portion of the workpiece to form a free-hanging tag.

The present invention provides an apparatus for affixing an adhesive tape having an adhesive to a workpiece having a cylindrical portion and an outer peripheral surface thereof, and the apparatus includes a tape-feeding device for feeding an adhesive tape below the outer peripheral surface in a condition in which the adhesive surface upwardly faces in a direction approximately perpendicular to an axis of the cylindrical portion, a tape-cutting device for cutting the adhesive tape fed from the tape-feeding device in a predetermined length, and a tape-affixing device for thrusting and affixing the adhesive surface of the adhesive tape which was cut by the tape-cutting device to the outer peripheral surface of the cylindrical portion in such a way that the tape-affixing device passes through both sides of the outer peripheral surface of the cylindrical portion from below thereof so as to elevate the adhesive tape. The tape-affixing device is arranged for the cut adhesive tape to be longer than the length of the outer periphery of the cylindrical portion such that adhesive surfaces at the ends of the cut adhesive tape are pressed and are adhered to each other after the adhesive surface of the adhesive tape was thrust and was adhered to the outer peripheral surface of the cylindrical portion.

In the apparatus for affixing an adhesive tape of the present invention, an adhesive tape is thrust and affixed to the outer peripheral surface of the cylindrical portion of a workpiece in such a way that the tape-affixing device passes through both sides of the outer peripheral surface of the cylindrical portion from below thereof so as to elevate the adhesive tape in a condition in which an adhesive surface of the cut adhesive tape faces upward. Then, adhesive surfaces at the ends of the cut adhesive tape longer than the length of the outer periphery of the cylindrical portion are pressed and are adhered to each other after the adhesive surface of the adhesive tape was thrust and was adhered to the outer peripheral surface of the cylindrical portion. Therefore, the adhesive tape is affixed to the cylindrical portion of the workpiece so as to form a free-hanging tag, and the workpiece is upwardly pulled out after the adhesive tape is affixed. Moreover, the adhesive tape can be automatically affixed, whereby the time for affixing is decreased, and the workpiece may be handled with both hands.

The apparatus for affixing an adhesive tape of the present invention may have various structures. For example, the tape-feeding device may comprise a rotating roll on which an adhesive tape is rolled and a rotating member by which the adhesive tape rolled on the rotating roll is fed in a predetermined direction.

In this case, the adhesive tape rolled on the rotating roll is fed in a predetermined direction by the rotation of a first rotating member and a second rotating member, whereby the adhesive tape can be fed below the cylindrical portion of the workpiece with a simple structure. Therefore, the structure of the apparatus can be simply formed.

In order to improve the performance of the tape-feeding device, various structures may be used. For example, the rotating member may comprise a first rotating member and a second rotating member which is disposed downstream of the first rotating member in a feeding path for an adhesive tape with a predetermined distance. The second rotating member may have a larger outer diameter than that of the first rotating member, and it may be set to rotate in the same direction and rotating frequency as the first rotating member.

In this case, the circumferential speed of the adhesive tape is faster at the second rotating member than at the first rotating member. According to such a difference between the circumferential speed at the first and the second rotating members, a back tension occurs in the adhesive tape between the first and the second rotating members, whereby the adhesive tape is easily peeled off from the second rotating member. Therefore, the adhesive tape can be smoothly fed.

The first rotating member may contact with the adhesive tape at a larger angle than the angle at which the second rotating member contacts with the adhesive tape, and the amount of the disposed first rotating member may be larger than that of the disposed second rotating member. In this case, adhesive power with respect to the adhesive tape of the second rotating member is smaller than that of the first rotating member, whereby the adhesive tape is very easily peeled off from the second rotating member. Therefore, the adhesive tape can be further smoothly fed.

The feeding path for the adhesive tape may be formed with a flat portion opposing the outer peripheral surface of the first rotating member, a concave portion opposing the outer peripheral surface of the second rotating member, and a connecting portion smoothly connecting the flat portion and the concave portion. In this case, the adhesive tape between the flat portion and the outer peripheral surface of the first rotating portion is fed in a flat shape in cross section, and the adhesive tape between the concave portion and the outer peripheral surface of the second rotating member is fed in a downwardly convex curved shape in cross section. Therefore, the extensibility of the adhesive tape is improved, and buckling strength is improved. Accordingly, the adhesive tape can be more smoothly fed.

In order to improve the performance of the tape-cutting device, various structures may be used. For example, the tape-cutting device may comprise a cutter rotatably provided to the shaft and downwardly rotating to the adhesive surface of the adhesive tape so as to cut, and a suction member provided at the shaft so as to synchronously rotate with the cutter. After the adhesive tape is cut, the cutter upwardly rotates and separates from the feeding path for the adhesive tape, and the suction member upwardly rotates and returns to the feeding path for the adhesive tape, so that a reverse surface of the adhesive surface of the adhesive tape cut by the cutter is suctioned and is peeled off from the cutter. In this case, the suction member is near the cutter and can peel off the cut adhesive tape from the cutter without causing damage.

In order to improve the performance of the tape-affixing device, various structures may be used. For example, the tape-affixing device may comprise a guide plate having a tape-feeding groove to which an adhesive tape is fed and having a workpiece-disposing groove formed in a direction perpendicular to the tape-feeding groove and on which the cylindrical portion of the workpiece is disposed, a through hole penetrating in a direction perpendicular to the crossing portion of the tape-feeding groove and the workpiece-disposing groove, and a thrust member provided in the through hole and is liftable and thrusting the outer peripheral surface of the cylindrical portion of the workpiece by raising therein. Two claws may be formed on the upper surface portion of the thrust member and may oppose the cylindrical portion of the workpiece in the upstream and the downstream of the feeding path for the adhesive tape with respect to the axis of the cylindrical portion of the workpiece. A hollow portion may be formed under the claws of the thrust member, and the two claws may be elastically deformable according to thrusting power due to the outer peripheral surface of the cylindrical portion of the workpiece.

In this case, according to the rise of the thrust member through the through hole penetrating in a direction perpendicular to the crossing portion of the tape-feeding groove and the workpiece-disposing groove, the two claws of the thrust member thrust and affix the adhesive tape on the outer peripheral surface of the cylindrical portion of the workpiece in such a way that the tape-affixing device passes through both sides of the outer peripheral surface of the cylindrical portion from below thereof so as to elevate the adhesive tape while deforming in accordance with the shape in cross section of the cylindrical portion of the workpiece. Simultaneously, ends of the adhesive tape smoothly rise along the tape-feeding groove while the adhesive tape is affixed to the outer peripheral surface of the cylindrical portion of the workpiece. Then, the two claws return to the former shape after they pass over the upper side of the outer peripheral surface of the cylindrical portion of the workpiece, and they continue to rise. Simultaneously, the cylindrical portion of the workpiece relatively moves down with respect to the claws in the hollow portion disposed under the claw, and the two claws hold ends of the adhesive tape longer than the length of the outer peripheral surface of the cylindrical portion of the workpiece and affix both adhesive surfaces thereof each other.

In this case, the adhesive tape is disposed at the tape-feeding groove of the guide plate, and the workpiece is disposed at the workpiece-disposing groove of the guide plate, whereby the cylindrical portion of the workpiece can be accurately positioned perpendicular to the adhesive tape. Moreover, the longitudinal length of the tape-feeding groove and the position where the adhesive tape is cut by the tape-cutting portion are suitably designed, whereby the centers of the cylindrical portion of the workpiece and the adhesive tape can be accurately made to coincide. The two claws of the thrust member are raised along the through hole formed in a direction perpendicular to the crossing portion of the tape-feeding groove and the workpiece-disposing groove, and the adhesive tape shifts along the tape-feeding groove when it is affixed by the two claws, whereby the adhesive tape may be affixed without displacement in the longitudinal direction and the width direction.

The surfaces of the two claws opposing the cylindrical portion of the workpiece may contact each other at the lower end portion and may have an upwardly convex shape in which the surfaces are gradually separated from each other toward upward direction. In this case, the adhesive tape is thrust by fitting to the outer peripheral surface of the cylindrical portion of the workpiece, whereby the adhesive tape may be affixed thereto while avoiding wrinkles.

A method for affixing an adhesive tape of the present invention is used for an apparatus for affixing an adhesive tape of the present invention. That is, in the method for affixing an adhesive tape of the present invention, an adhesive tape is fed below the outer peripheral surface of a cylindrical portion of a workpiece in a condition in which an adhesive surface faces upwardly in a direction approximately perpendicular to the axis of the cylindrical portion. Then, the fed adhesive tape is cut in a predetermined length, and the adhesive surface of the cut adhesive tape is thrust and affixed to the outer peripheral surface of the cylindrical portion of the workpiece in such a way that a tape-affixing device passes through both sides of the outer peripheral surface of the cylindrical portion from below thereof so as to elevate the adhesive tape. Adhesive surfaces at the ends of the cut adhesive tape longer than the length of the outer periphery of the cylindrical portion are pressed and are adhered to each other after the adhesive surface of the adhesive tape was thrust and was adhered to the outer peripheral surface of the cylindrical portion. The method for affixing an adhesive tape of the present invention provides the same functions and effects as the apparatus for affixing an adhesive tape of the present invention.

According to the method or the apparatus for affixing an adhesive tape of the present invention, an adhesive surface of a cut adhesive tape is thrust and affixed to the outer peripheral surface of an cylindrical portion of a workpiece in such a way that a tape-affixing device passes through both sides of the outer peripheral surface of the cylindrical portion from below thereof so as to elevate the adhesive tape. Adhesive surfaces at ends of the cut adhesive tape longer than the length of the outer periphery of the cylindrical portion are pressed and are adhered to each other after the adhesive surface of the adhesive tape was thrust and was adhered to the outer peripheral surface of the cylindrical portion. Therefore, the adhesive tape is affixed to the outer peripheral surface of the cylindrical portion of the workpiece in the form of a free-hanging tag, and the workpiece is upwardly pulled out after the adhesive tape is affixed. Moreover, the adhesive tape can be automatically affixed to the workpiece, whereby time for affixing is decreased, and the workpiece may be handled with both hands.

BRIEF DESCRIPTION OF DRAWINGS

FIGS. 5A to 5C show enlarged structures of a tape-feeding portion of an apparatus for affixing an adhesive tape relating to an embodiment of the present invention, wherein FIG. 5A is a front view of the apparatus, FIG. 5B is a sectional view taken along line a-a in FIG. 5A, and FIG. 5C is a sectional view taken along line b-b in FIG. 5A.

FIGS. 7A to 7C show operating states of the tape-cutting portion of FIG. 6, wherein FIG. 7A is a side view showing a rising state of an upper cutter of the tape-cutting portion, FIG. 7B is a front view showing a rising state of an upper cutter of the tape-cutting portion, and FIG. 7C is a side view showing a downward moving state of an upper cutter of the tape-cutting portion.

PREFERRED EMBODIMENTS OF THE INVENTION

1 Compositions of Embodiments

1-1 Overall Structure of Apparatus

Figure 1:
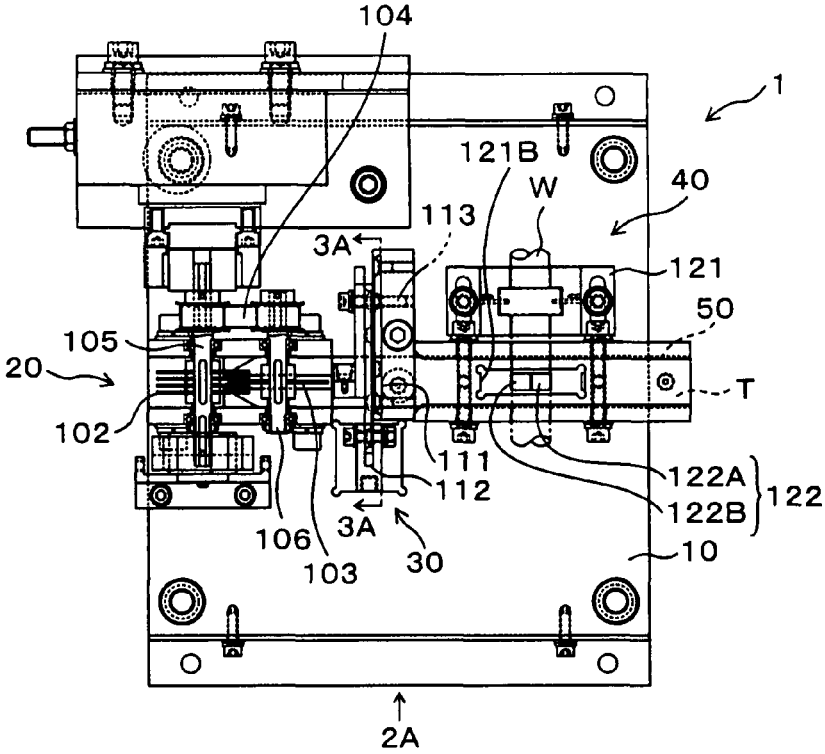
FIG. 1 shows a structure of an apparatus for affixing an adhesive tape relating to an embodiment of the present invention: it is a top view of a structure below a rotating roll of a tape-feeding portion in the apparatus.
Figure 2:
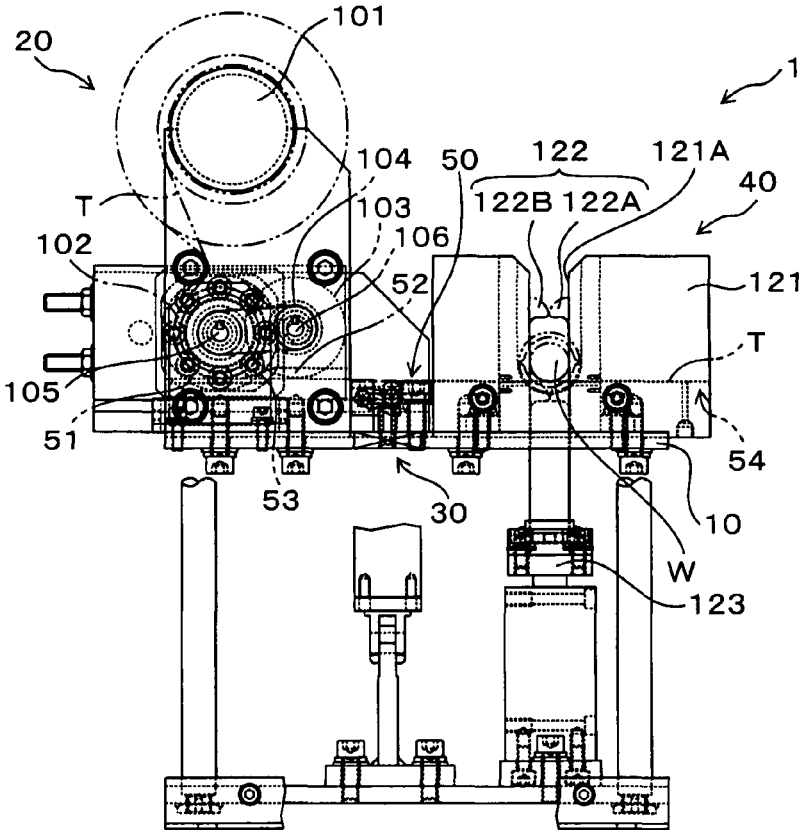
FIG. 2 shows a front view of the apparatus for affixing an adhesive tape viewed from the direction of arrow 2A in FIG. 1.
Figure 3:
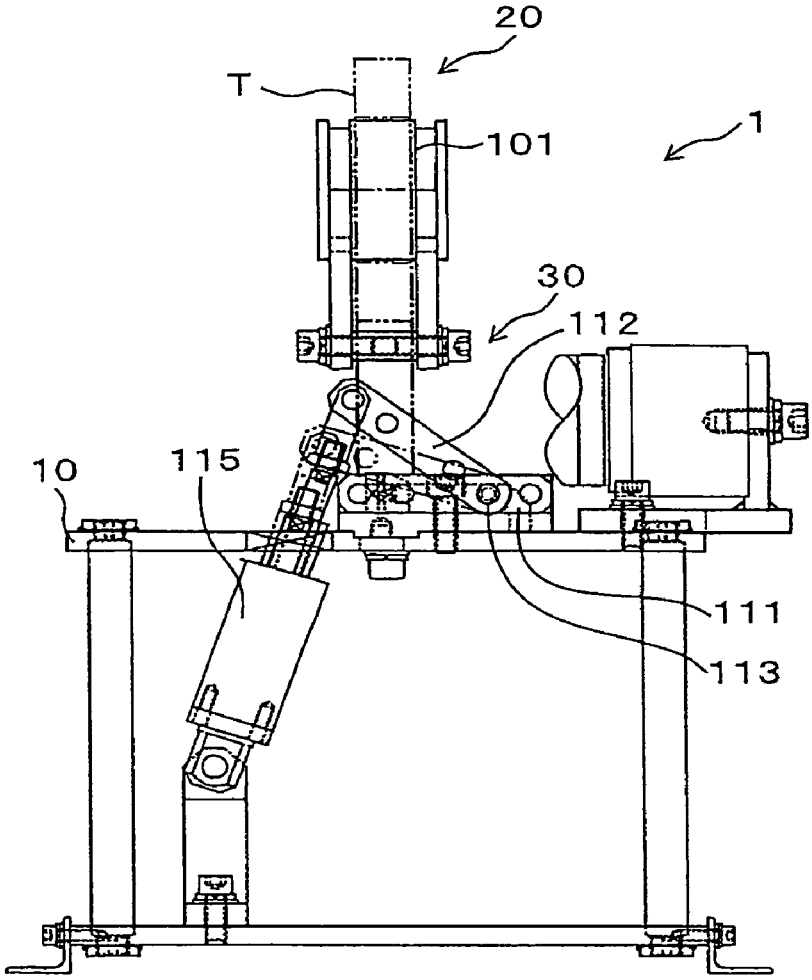
FIG. 3 shows a side view of the apparatus for affixing an adhesive tape taken in the direction of the arrows along line 3A-3A in FIG. 1.

An embodiment of the present invention will be explained hereinafter with reference to drawings. FIGS. 1 to 3 show structures of an apparatus 1 for affixing an adhesive tape relating to an embodiment of the present invention. FIG. 1 shows a structure of an apparatus 1 for affixing an adhesive tape; it is a top view of a structure below a rotating roll 101 of a tape-feeding portion 20 in the apparatus 1. FIG. 2 shows a front view of the apparatus 1 for affixing an adhesive tape viewed from the direction of an arrow 2A of FIG. 1. FIG. 3 shows a side view of the apparatus 1 for affixing an adhesive tape taken in the direction of the arrows along the line 3A-3A in FIG. 1. Double-dashed chain lines, which correspond to a thrust member 122 in FIG. 2, show the thrust member 122 after an adhesive tape T is affixed, and a double-dashed chain line, which corresponds to an upper cutter 112, shows the upper cutter 112 after the adhesive tape T is cut. It should be noted that the method for affixing an adhesive tape of the present invention is performed by the apparatus 1 for affixing an adhesive tape.

The apparatus 1 for affixing an adhesive tape is used for affixing the adhesive tape T to a workpiece W having a cylindrical portion. One side of the adhesive tape T is an adhesive surface formed by coating with an adhesive, for example. The apparatus 1 for affixing an adhesive tape comprises a base 10. The base 10 is provided with a tape-feeding portion 20 (tape-feeding device), a tape-cutting portion 30 (tape-cutting device), and a tape-affixing portion 40 (tape-affixing device), and a tape-feeding path 50 to which the adhesive tape T is fed linearly extending from the tape-feeding portion 20 to the tape-affixing portion 40. The cylindrical portion of the workpiece W on which the adhesive tape T is affixed is disposed in the tape-affixing portion in a direction perpendicular to the tape-feeding path 50.

The tape-feeding portion 20 feeds the adhesive tape T through the tape-feeding path 50 in a condition such that the adhesive surface faces upwardly so as to feed the adhesive tape T below the cylindrical portion of the workpiece W in a direction perpendicular to the axis of the cylindrical portion of the workpiece W. The tape-cutting portion 30 cuts the adhesive tape T fed by the tape-feeding portion 20 in a predetermined length. The adhesive tape T in which the adhesive surface faces upwardly is thrust and is affixed to the outer peripheral surface of the cylindrical portion of the workpiece W in such a way that a tape-affixing portion 40 passes through both sides of the outer peripheral surface of the cylindrical portion from below thereof so as to elevate the adhesive tape T. Then, the tape-affixing portion 40 thrusts and affixes adhesive surfaces at ends of the adhesive tape T longer than the length of the outer periphery of the cylindrical portion of the workpiece W to each other. The tape-feeding portion 20, the tape-cutting portion 30, and the tape-affixing portion 40 will be explained in detail hereinafter.

1-2 Composition of Tape-Feeding Portion

Figure 4:
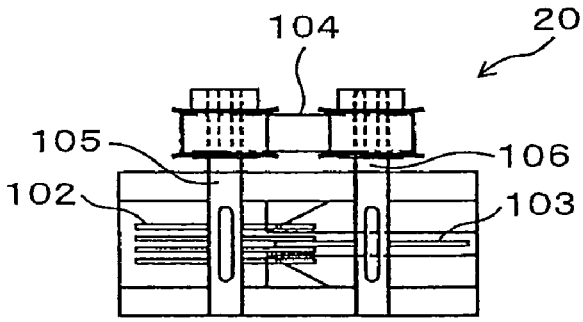
FIG. 4 is a top view showing a part of a structure of a tape-feeding portion of an apparatus for affixing an adhesive tape relating to an embodiment of the present invention.
Figure 5A:
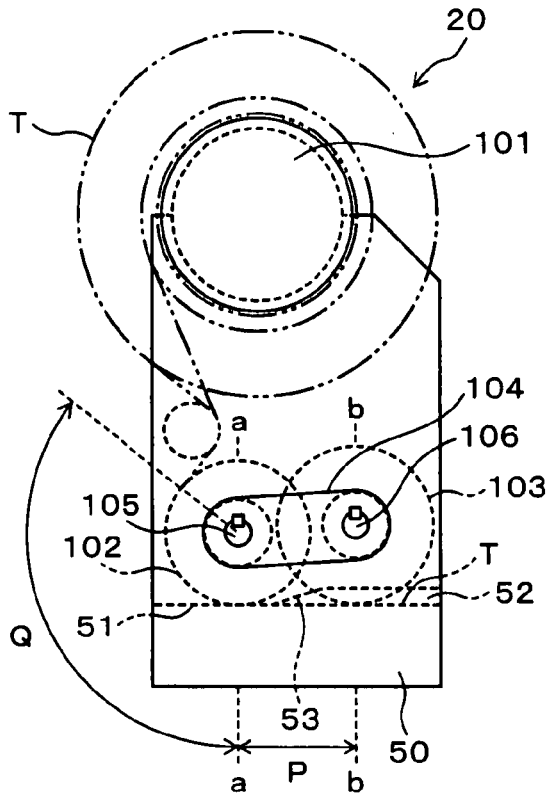
Figure 5B:
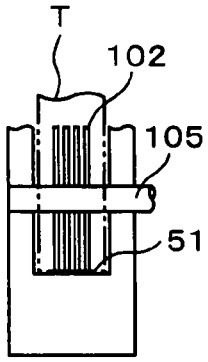
Figure 5C:
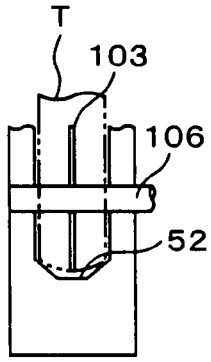

FIG. 4 is a top view showing a part of a structure of a tape-feeding portion 20. FIGS. 5A to 5C show enlarged structures of the tape-feeding portion 20, wherein FIG. 5A is a front view of the apparatus, FIG. 5B is a sectional view taken along line a-a in FIG. 5A, and FIG. 5C is a sectional view taken along line b-b in FIG. 5A.

The tape-feeding portion 20 comprises a rotating roll 101 on which the adhesive tape T is rolled. The adhesive surface of the adhesive tape T faces the radial inner side of the rotating roll 101. The adhesive tape T rolled on the rotating roll 101 is fed through the tape-feeding path 50 by rotating a small diameter disc 102 (first rotating member) and a large diameter disk 103 (second rotating member). The disk 102 has a rotating shaft 105 and the disk 103 has a rotating shaft 106, and the rotating shafts 105 and 106 are connected to a rotating mechanism 104 so as to rotate in the same direction and rotating frequency.

The small diameter disk 102 is provided upstream of the tape-feeding path 50, and the large diameter disk 103 is provided downstream of the tape-feeding path 50. The disks 102 and 103 overlap between the rotating shafts 105 and 106, and the lower sides of the outer peripheral surfaces thereof are disposed so as to face the tape-feeding path 50. The outer peripheral surfaces of the disks 102 and 103 are formed with a slip prevention portion with respect to the adhesive tape T.

The small diameter disk 102 has a smaller outer diameter than that of the large diameter disk 103, and the amount of the disposed small diameter disk 102 is larger than that of the disposed large diameter disk 103. In the embodiment, four small diameter disks 102 are disposed at even intervals, and one large diameter disk 103 is disposed between the two small diameter disks 102 placed at the middle of the four small diameter disks 102. The small diameter disk 102 contacts the adhesive tape T at larger angle than the angle at which the large diameter disk 103 contacts the adhesive tape T. It should be noted that the angle at which the small diameter disk 102 contacts the adhesive tape T is indicated by an angle Q in FIG. 5A.

In the tape-feeding path 50 in the tape-feeding portion 20, a flat portion 51 is formed at a portion opposing the lower side of the outer peripheral surface of the small diameter disk 102, and a concave portion 52 is formed at a portion opposing the lower side of the outer peripheral surface of the large diameter disk 103. The flat portion 51 and the concave portion 52 are smoothly connected by a connecting portion 53. The flat portion 51 has a width slightly greater than that of the adhesive tape T, and the upper side of the concave portion 52 has the same width as the flat portion 51.

1-3 Composition of Tape-Cutting Portion

Figure 6:
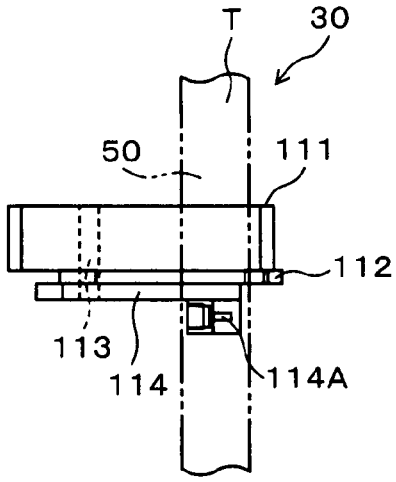
FIG. 6 is a top view showing an enlarged structure of a tape-cutting portion of an apparatus for affixing an adhesive tape relating to an embodiment of the present invention.
Figure 7A:
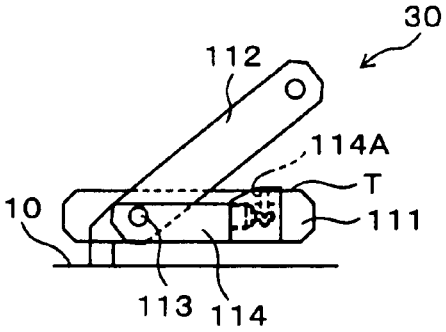
Figure 7B:
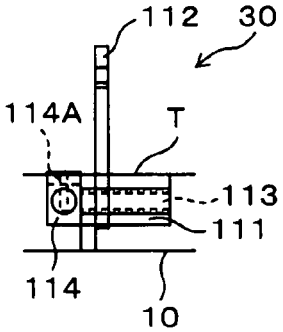
Figure 7C:
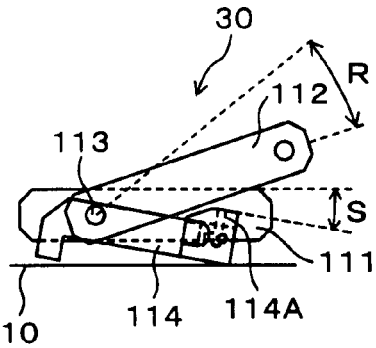

FIG. 6 is a top view showing an enlarged structure of a tape-cutting portion 30. FIGS. 7A to 7C show operating states of the tape-cutting portion 30, wherein FIG. 7A is a side view showing a raising state of an upper cutter 112 of the tape-cutting portion 30, FIG. 7B is a front view showing a raising state of an upper cutter 112 of the tape-cutting portion 30, and FIG. 7C is a side view showing a downward moving state of an upper cutter 112 of the tape-cutting portion 30. The tape-cutting portion 30 comprises a lower cutter 111 and an upper cutter 112 for cutting the adhesive tape T, and a suction member 114 for applying suction to a reverse surface of the adhesive surface of the adhesive tape T.

The lower cutter 111 is fixed on the base 10. The tape-feeding path 50 for the adhesive tape T extends over the upper surface of the lower cutter 111. An end portion of the upper cutter 112 is provided to a turning shaft 113 at the side portion of the lower cutter 111, and the other end portion of the upper cutter 112 is turnable around the turning shaft 113. The other end portion of the upper cutter 112 is connected with a turning mechanism 115 and is turned thereby. The upper cutter 112 is disposed in a direction perpendicular to the tape-feeding path 50. The upper cutter 112 turns with respect to the lower cutter 112 from a raising state shown in FIGS. 7A and 7B to a downward moving state shown in FIG. 7C, thereby cutting the adhesive tape T. The turning range of the upper cutter 112 is limited to a range of angle R shown in FIG. 7C.

The suction member 114 is adjacent to the upper cutter 112 and is turnably provided around the turning shaft 113, and it synchronously slides with the upper cutter 112 by friction occurring at the upper cutter 112. The turning range of the suction member 114 is limited to a range of angle S shown in FIG. 7C, and the angle S is smaller than the angle R which is the turning range of the upper cutter 112. The suction member 114 has a suction opening 114A connected to a vacuum portion (not shown in the figures).

When the suction member 114 is in a raising state, the suction opening 114A is placed at the tape-feeding path 50 as shown in FIGS. 7A and 7B, whereby the adhesive tape T can be held by suction. When the suction member 114 is in downward moving state, the suction opening 114A is separated from the tape-feeding path 50, whereby the adhesive tape T cannot be held by suction.

1-4 Composition of Tape-Affixing Portion

Figure 8:
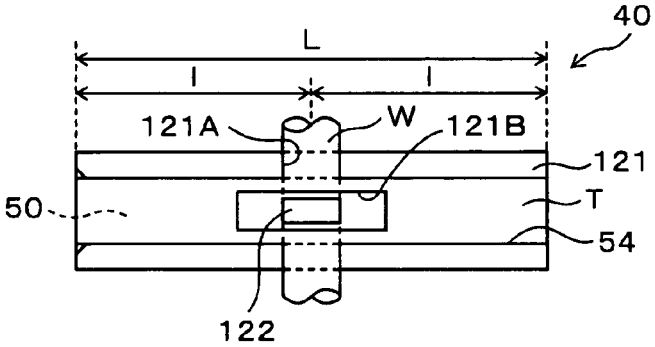
FIG. 8 is a top view showing an enlarged structure of a tape-affixing portion of an apparatus for affixing an adhesive tape relating to an embodiment of the present invention.
Figure 9:
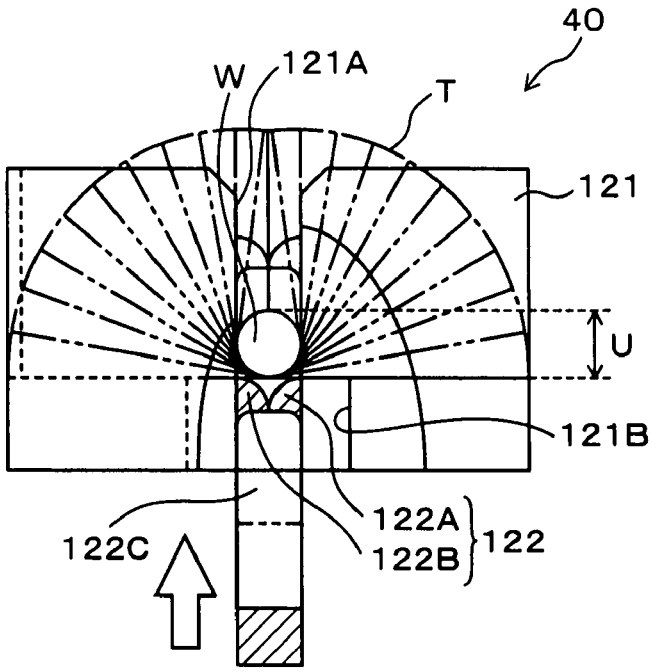
FIG. 9 is a side view showing a state in which an adhesive tape is being affixed to a workpiece in the tape-affixing portion of FIG. 8.
Figure 10:
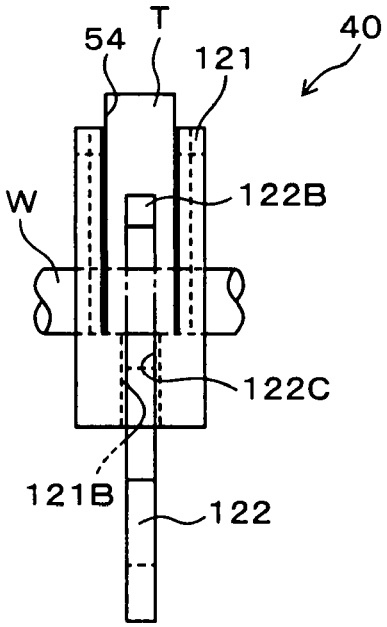
FIG. 10 shows a side view of the tape-affixing portion of FIG. 8.

FIG. 8 is a top view showing an enlarged structure of a tape-affixing member 40. FIG. 9 is a side view showing a state in which an adhesive tape T is being affixed to a workpiece W. FIG. 10 is a side sectional view showing an enlarged structure of the tape-affixing member 40. It should be noted that, in FIG. 9, double-dashed chain lines corresponding to the adhesive tape T show a state in which the adhesive tape T is being affixed, and solid lines corresponding to a thrust member 122 shows the thrust member 122 after the adhesive tape T is affixed. The tape-affixing portion 40 comprises a guide plate 121 having a rectangular parallelepiped shape. A tape-feeding groove 54 forming a part of the tape-feeding path 50 is formed in the longitudinal direction of the guide plate 121. A workpiece-disposing groove 121A on which a workpiece W is disposed is formed in a direction perpendicular to the tape-feeding groove 54 in the width direction of the guide plate 121.

The cylindrical portion of the workpiece W on which the adhesive tape T is affixed is disposed at the crossing portion of the tape-feeding groove 54 and the workpiece-disposing groove 121A. In the extending direction of the tape-feeding path 50, a distance from the upper cutter 112 to the axis of the cylindrical portion of the workpiece W and a distance from the axis of the cylindrical portion of the workpiece W to the right end of the tape-feeding groove 54 are defined to have a length l. Therefore, when the adhesive tape T reaches the right end of the tape-feeding groove 54, the adhesive tape T is cut by the upper cutter 112, thereby yielding the adhesive tape T having a length of L (2*l*) in which the center of the workpiece W corresponds to the center in the longitudinal direction of the adhesive tape T.

A through hole 121B penetrating in a direction perpendicular to the guide plate 121 is formed at the crossing portion of the tape-feeding groove 54 and the workpiece-disposing groove 121A. A thrust member 122 is provided in the through hole 121B and is liftable, and it is made from an elastic material, for example. The thrust member 122 is lifted by a lifting mechanism 123 connected to the lower end portion of the thrust member 122. The adhesive tape T is affixed to the cylindrical portion of the workpiece W by raising the thrust member 122.

Claws 122A and 122B are formed on the upper surface of the thrust member 122, and they thrust the outer peripheral surface of the cylindrical portion of the workpiece W passing through both sides of the outer peripheral surface of the cylindrical portion of the workpiece W from below thereof so as to elevate the adhesive tape. A hollow portion 122C is formed under the claws 122A and 122B. The claw 122A is disposed downstream of the tape-feeding path 50 with respect to the axis of the cylindrical portion of the workpiece W, and the claw 122B is disposed upstream of the tape-feeding path 50 with respect to the axis of the cylindrical portion of the workpiece W, and they oppose each other. The sides of the claws 122A and 122B opposing the cylindrical portion of the workpiece W contact each other at the lower end portion, and they have an upwardly convex shape in which the surfaces are gradually separated from each other toward upward direction. The claws 122A and 122B having such a shape contact with the workpiece W in a range U shown in FIG. 8, when the adhesive tape T is affixed to the workpiece W by raising the thrust member 122.

2 Operation of Embodiment

An operation of the apparatus 1 for affixing an adhesive tape will be explained with reference to the drawings. As shown in FIG. 4 and FIGS. 5A to 5C, in the tape-feeding portion 20, when the small diameter disk 102 and the large diameter disk 103 are driven and rotate by the rotating mechanism 104, an adhesive tape T rolled on the rotating roll 101 is fed to the tape-cutting portion 30 and the tape-affixing portion 40 through the tape-feeding path 50. While the adhesive tape T is fed, the adhesive surface of the adhesive tape T faces upwardly.

The rotating mechanism 104 rotates the small diameter disk 102 and the large diameter disk 103 at the same direction and rotating frequency. In this case, the large diameter disk 103 has an outer diameter larger than that of the small diameter disk 102, whereby the circumferential speed of the adhesive tape T is higher at the large diameter disk 103 than at the small diameter disk 102. According to such a difference between the circumferential speed at the small diameter disk 102 and the large diameter disk 103, a back tension occurs at the distance P of the adhesive tape T shown in FIG. 5A. On the other hand, the amount of the disposed small diameter disk 102 is larger than that of the disposed large diameter disk 103, and the small diameter disk 102 contacts the adhesive tape T at a larger angle than the angle at which the large diameter disk 103 contacts the adhesive tape T. Therefore, the adhesive power with respect to the adhesive tape T at the small diameter disk 102 is larger than the adhesive power with respect to the adhesive tape T at the large diameter disk 103, and the back tension occurs at the distance P, whereby the adhesive tape T is easily peeled off from the large diameter disk 103.

As shown in FIG. 5B, the lower side of the outer peripheral surface of the small diameter disk 102 is disposed at the flat portion 51, and the adhesive tape T therebetween is thrust by the small diameter disk 102 and is fed in a flat shape in cross section. As shown in FIG. 5C, the large diameter disk 103 is disposed to the concave portion 52, and the adhesive tape T therebetween is thrust by the large diameter disk 103 and is fed in a downwardly convex curved shape in cross section. The adhesive tape T is fed while smoothly changing its shape in cross section from a flat shape to a curved shape along a tape-feeding direction at the connecting portion 53 between the small diameter disk 102 and the large diameter disk 103. In the adhesive tape T in a curved shape, the extensibility is improved, and the buckling strength is increased.

The adhesive tape T fed from the tape-feeding portion 20 passes under the outer peripheral surface of the cylindrical portion of the workpiece W disposed on the workpiece-disposing groove 121A in the tape-affixing portion 40. As shown in FIG. 8, the adhesive tape T is cut by the tape-cutting portion 30 when it reaches the right end of the tape-feeding groove 54 of the guide plate 121 in the tape-affixing portion 40. Specifically, the upper cutter 112 in a raised state, as shown in FIGS. 7A and 7B, moves down toward the lower cutter 111 as shown in FIG. 7C, whereby the adhesive tape T is cut.

In this case, because the adhesive surface of the adhesive tape T faces upwardly, the upper cutter 112 may adhere to the adhesive surface of the adhesive tape T. As shown in FIG. 7C, when the adhesive tape T is cut, the suction member 114 synchronously moves down with the upper cutter 112 by friction occurred at the upper cutter 112, and the suction opening 114A is separated from the tape-feeding path 50. As shown in FIGS. 7A and 7B, after the adhesive tape T is cut, the suction member 114 is synchronously raised with the upper cutter 112 by friction occurring at the upper cutter 112, and the suction opening 114A returns to the tape-feeding path 50. In this case, the reverse surface of the adhesive surface of the adhesive tape T that adhered to the upper cutter 112 is held by suction at the suction opening 114A, whereby the adhesive tape T that adhered to the upper cutter 112 is peeled off therefrom.

Thus, the adhesive tape T is cut by the tape-cutting portion 30, thereby obtaining the adhesive tape T having a length of L (2*l*) as shown in FIG. 8. In this case, the center of the adhesive tape T in the longitudinal direction is placed at the crossing portion of the tape-feeding groove 54 and the workpiece-disposing groove 121A, and it corresponds to the center of the workpiece W.

In the tape-affixing portion 40, the thrust member 122 is placed at the crossing portion of the tape-feeding groove 54 and the workpiece-disposing groove 121A, and it is driven and raised by the lifting mechanism 123 as shown in FIG. 9. Then, while the claws 122A and 122B of the thrust member 122 elastically deform in accordance with the shape in cross section of the cylindrical portion of the workpiece W, they thrust the adhesive tape T on the outer peripheral surface of the cylindrical portion of the workpiece W passing through both sides of the outer peripheral surface of the cylindrical portion from below thereof so as to elevate the adhesive tape. Therefore, the adhesive tape T is affixed by fitting on the outer peripheral surface of the cylindrical portion of the workpiece W. Simultaneously, ends of the adhesive tape T are gradually raised along the tape-feeding groove 54 by drawing an arc which centers on the axis of the cylindrical portion of the workpiece W as double-dashed chain lines shown in FIG. 9.

After the claws 122A and 122B of the thrust member 122 pass the upper side of the outer peripheral surface of the cylindrical portion of the workpiece W, they return to the former shape by elastically deforming and continue to be raised. In this case, the cylindrical portion of the workpiece moves down inside of the hollow portion 122C placed under the claws 122A and 122B. Simultaneously, the claws 122A and 122B hold ends of the adhesive tape T longer than the length of the outer peripheral surface of the cylindrical portion of the workpiece W and affix the adhesive surfaces thereof to each other. Therefore, the adhesive tape T is affixed to the cylindrical portion of the workpiece W in the form of a free-hanging tag.

Figure 11:
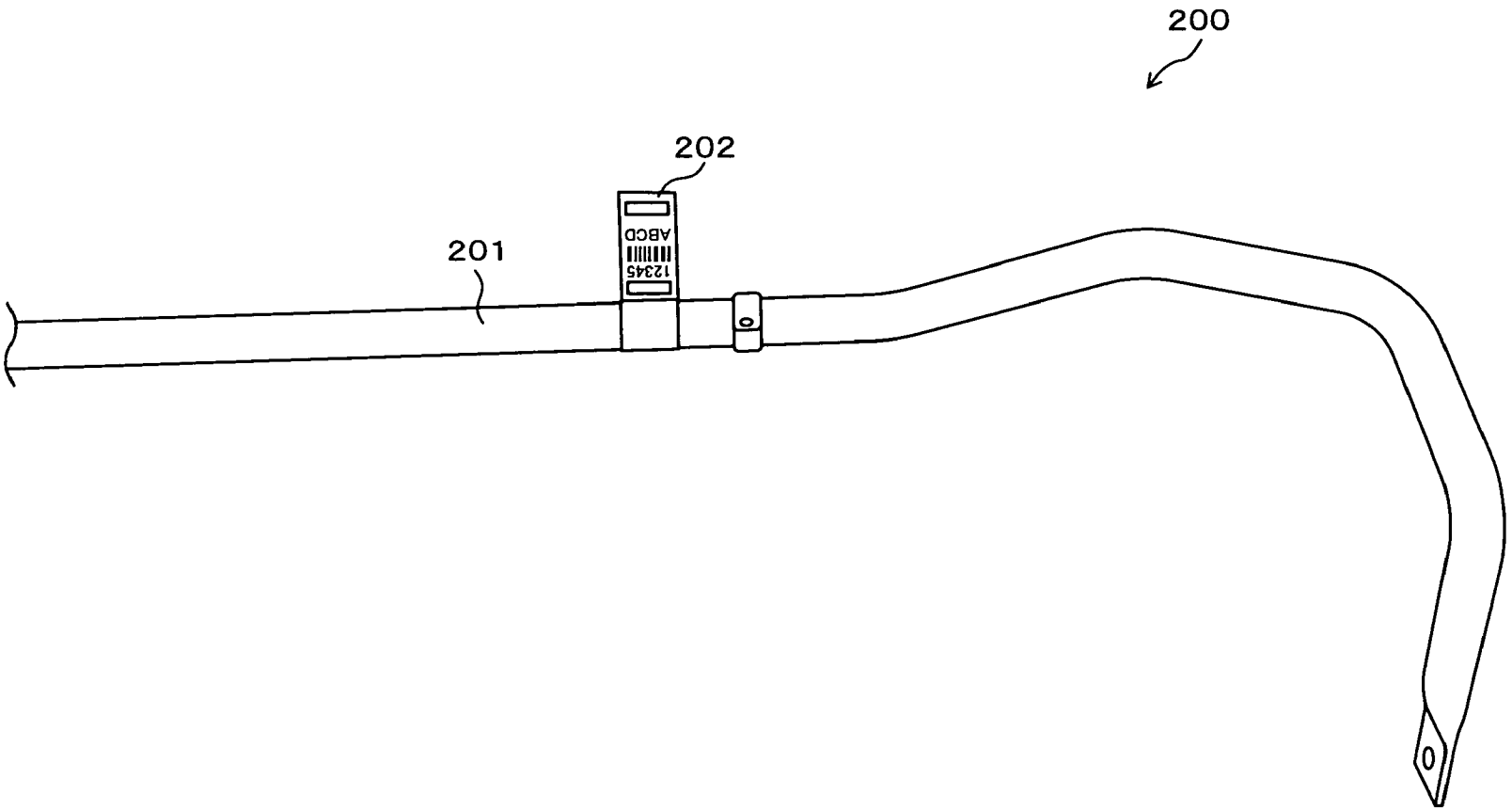
FIG. 11 shows a component drawing of one side portion of an example of a workpiece on which an adhesive tape is affixed by an apparatus for affixing an adhesive tape relating to an embodiment of the present invention.

As a workpiece W on which the adhesive tape T is affixed in the form of a free-hanging tag in this way, a stabilizer 200 for vehicles shown in FIG. 11 may be mentioned. In the stabilizer 200 for vehicles, an adhesive tape 202, which is an adhesive tape T printed with a barcode for identifying the product, is affixed to a torsion portion 201 that is a cylindrical portion in the form of a tag.

As mentioned above, in the embodiment, the cut adhesive tape T is thrust and is affixed to the outer peripheral surface of the cylindrical portion of the workpiece W in such a way that the claws 122A and 122B of the thrust member 122 pass through both sides of the outer peripheral surface of the cylindrical portion of the workpiece W from below thereof so as to elevate the adhesive tape in a condition in which the adhesive surface faces upwardly. Adhesive surfaces at ends of the cut adhesive tape longer than the length of the outer periphery of the cylindrical portion are pressed and are adhered to each other after the adhesive surface of the adhesive tape was thrust and was adhered to the outer peripheral surface of the cylindrical portion. Therefore, the adhesive tape T is affixed to the cylindrical portion of the workpiece W in the form of a free-hanging tag, and the workpiece W is upwardly pulled out after the adhesive tape T is affixed. Moreover, the adhesive tape T can be automatically affixed to the workpiece W, whereby the affixing time is reduced, and the workpiece W is handled with both hands.

Specifically, in the tape-feeding portion 20, the adhesive tape T is fed to the cylindrical portion of the workpiece W by a simple structure in which the adhesive tape T rolled on the rotating roll 101 is fed by rotating the small diameter disk 102 and the large diameter disk 103. Therefore, the apparatus can be formed with a simple structure.

A back tension occurs at the adhesive tape T between the small diameter disk 102 and the large diameter disk 103, whereby the adhesive tape T is easily peeled off from the large diameter disk 103. Therefore, the adhesive tape T can be smoothly fed. Moreover, the adhesive power with respect to the adhesive tape T of the large diameter disk 103 is less than the adhesive power with respect to the adhesive tape T of the small diameter disk 102, whereby the adhesive tape T is very easily peeled off from the large diameter disk 103. Accordingly, the adhesive tape T can be smoothly fed.

The adhesive tape T between the flat portion 51 and the outer peripheral surface of the small diameter disk 102 is fed in a flat shape in cross section, and the adhesive tape T between the concave portion 52 and the outer peripheral surface of the large diameter disk 103 is fed in a downwardly convex curved shape in cross section. Therefore, in the adhesive tape T, the extensibility may be improved, and the buckling strength may be increased. Accordingly, the adhesive tape T can be further smoothly fed. Moreover, in the tape-cutting portion 30, the suction member 114 near the upper cutter 112 can peel off the adhesive tape T from the upper cutter 112 without causeing damage.

In addition, the adhesive tape T is disposed at the tape-feeding groove 54 of the guide plate 121, and the workpiece is disposed at the workpiece-disposing groove 121A of the guide plate 121, whereby the cylindrical portion of the workpiece W may be accurately positioned perpendicular to the adhesive tape T. Moreover, the longitudinal length of the tape-feeding groove 54 and the position where the adhesive tape T is cut by the tape-cutting portion 30 are suitably designed, whereby the centers of the cylindrical portion of the workpiece W and the adhesive tape T may be accurately made to coincide. The two claws 122A and 122B of the thrust member 122 are raised along the through hole 121B formed in a direction perpendicular to the crossing portion of the tape-feeding groove 54 and the workpiece-disposing groove 121A, and the adhesive tape T shifts along the tape-feeding groove 54 when it is affixed by the two claws, whereby the adhesive tape T may be affixed without a displacement in the longitudinal direction and the width direction. In this case, the adhesive tape T is thrust by fitting to the outer peripheral surface of the cylindrical portion of the workpiece W, whereby the adhesive tape T may be affixed thereto while avoiding wrinkles.

(3) Variation of Embodiment

As mentioned above, the present invention is explained by the above embodiments, but the invention is not limited thereto and may be modified in various ways. For example, in the above embodiments, a stabilizer for vehicles is used as a workpiece W, but various members having cylindrical portion may be used. In the above embodiment, the cylindrical portion of the workpiece W has a circular shape in axial cross section, but this is not limited thereto and may have an approximately circular shape (for example, an oval shape). In the above embodiment, the adhesive tape T has a length longer than the length of the outer periphery of the cylindrical portion of the workpiece W, and it is affixed to the cylindrical portion of the workpiece W in the form of a free-hanging tag. Moreover, an adhesive tape T may have a length that is not more than the length of the outer periphery of a cylindrical portion of a workpiece W, and it may be affixed to only the outer peripheral surface of the cylindrical portion of the workpiece W.

What is claimed is:

1. An apparatus for affixing an adhesive tape to a workpiece, wherein the apparatus is configured to dispense the adhesive tape and the workpiece has a cylindrical portion and an outer peripheral surface, the apparatus comprising:

A tape-feeding device configured to feed the adhesive tape below the outer peripheral surface of the workpiece in a condition in which an adhesive surface of the adhesive tape faces upwardly in a direction approximately perpendicular to an axis of the cylindrical portion of the workpiece;

A tape-cutting device configured to cut the adhesive tape fed from the tape-feeding device at a predetermined length that is greater than a circumference of the outer peripheral surface of the workpiece; and A tape-affixing device having two claws which are configured to be elastically deformable in response to a force exerted by the outer peripheral surface of the cylindrical portion of the workpiece, the tape-affixing device being configured to thrust and affix the adhesive surface of the cut adhesive tape to the outer peripheral surface of the cylindrical portion of the workpiece in such a way that an upward movement of the two claws causes the adhesive tape to be elevated, wherein the two claws are configured to be forced apart by the cylindrical portion of the workpiece as the two claws move upward and contact the outer peripheral surface of the cylindrical portion of the workpiece, Wherein the two claws are arranged so that adhesive surfaces at ends of the cut adhesive tape are pressed against and are adhered to each other after the adhesive surface of the adhesive tape is thrust against and adhered to the outer peripheral surface of the cylindrical portion, Wherein the tape-affixing device additionally comprises a through hole penetration in a direction that is perpendicular to a crossing portion of a tape-feeding groove and a workpiece-disposing groove.

2. The apparatus for affixing an adhesive tape according to claim 1, wherein the tape-feeding device comprises:

A rotating roll on which the adhesive tape is rolled; and

A rotating device for feeding the adhesive tape rolled on the rotating roll in a predetermined direction.

3. The apparatus for affixing an adhesive tape according to claim 2, wherein the rotating device comprises:

at least one first rotating member; and

A second rotating member disposed downstream of each of the at least one first rotating member in a feeding path for adhesive tape at a predetermined distance, and Wherein the second rotating member has a larger outer diameter than that of each one of the at least one first rotating member and rotates in the same direction and rotating frequency as each of the at least one first rotating member.

4. The apparatus for affixing an adhesive tape according to claim 3, wherein each of the at least one first rotating member is associated with a first angle of a contact portion at which the associated first rotating member contacts the adhesive tape, the first angle being defined as an angle between a first line and a second line, the first line connecting one end of the contact portion of the associated first rotating member and a center of the associated first rotating member, the second line connecting another end of the contact portion of the associated first rotating member and the center of the associated first rotating member, and A second angle of a contact portion at which the second rotating member contacts the adhesive tape is defined as an angle between a third line and a fourth line, the third line connecting one end of the contact portion of the second rotating member and a center of the second rotating member, the fourth line connecting another end of the contact portion of the second rotating member and the center of the second rotating member and The first angle of the contact portion of each of the at least one first rotating member is larger than the second angle of the contact portion of the second rotating member and the rotating device includes more first rotating members than second rotating members.

5. The apparatus for affixing an adhesive tape according to claim 3,

Wherein the feeding path for the adhesive tape is formed with a flat portion opposing an outer peripheral surface of each of the at least one first rotating member, a concave portion opposing an outer peripheral surface of the second rotating member, and a connecting portion smoothly connecting the flat portion and the concave portion.

6. The apparatus for affixing an adhesive tape according to claim 1, wherein the tape-cutting device comprises:

A cutter rotatably provided to on a shaft and downwardly rotating to the adhesive surface of the adhesive tape so as to cut the adhesive tape; and A suction member provided on the shaft so as to synchronously rotate with the cutter, Wherein the suction member downwardly rotates so as to retract from the feeding path for of the adhesive tape when the adhesive tape is cut, Wherein after the adhesive tape is cut, the cutter upwardly rotates and departs from the feeding path for the adhesive tape, and Wherein the suction member upwardly rotates and returns to the feeding path of the adhesive tape so that a reverse surface of the adhesive surface of the adhesive tape cut by the cutter is subjected to suction and is peeled off from the cutter.

7. The apparatus for affixing an adhesive tape according to claim 1, wherein the tape-affixing device comprises:

A guide plate having a tape-feeding groove through which the adhesive tape is fed and having a workpiece-disposing groove formed in a direction perpendicular to the tape-feeding groove, the cylindrical portion of the workpiece being disposed on the guide plate;

A thrust member vertically movable through the through hole, the thrust member being configured to rise through the through hole when the thrust member is thrusted toward the outer peripheral surface of the cylindrical portion of the workpiece, Wherein the two claws are formed on an upper surface portion of the thrust member and oppose the cylindrical portion of the workpiece upstream and downstream of the feeding path of the adhesive tape with respect to the axis of the cylindrical portion of the workpiece, Wherein a hollow portion is formed under the claws of the thrust member.

8. The apparatus for affixing an adhesive tape according to claim 7, wherein surfaces of the two claws opposing the cylindrical portion of the workpiece contact each other at a lower end portion and have an upwardly convex shape in which the surfaces gradually separate from each other toward an upward direction.

* * * * *